US010390622B2

(12) United States Patent
Vidrean

(10) Patent No.: US 10,390,622 B2
(45) Date of Patent: Aug. 27, 2019

(54) CHAIR COLUMN ARRANGEMENT

(71) Applicant: Stabilus GmbH, Koblenz (DE)

(72) Inventor: Mihai-Augustin Vidrean, Sighisoara (RO)

(73) Assignee: STABILUS GMBH, Koblenz (DE)

( * ) Notice: Subject to any disclaimer, the term of this patent is extended or adjusted under 35 U.S.C. 154(b) by 76 days.

(21) Appl. No.: 15/840,789

(22) Filed: Dec. 13, 2017

(65) Prior Publication Data

US 2018/0160814 A1 Jun. 14, 2018

(30) Foreign Application Priority Data

Dec. 13, 2016 (DE) ..... 10 2016 124 160

(51) Int. Cl.
*A47C 3/18* (2006.01)
*A47C 7/00* (2006.01)
*A47C 7/72* (2006.01)

(52) U.S. Cl.
CPC ..... *A47C 3/18* (2013.01); *A47C 7/004* (2013.01); *A47C 7/72* (2013.01)

(58) Field of Classification Search
CPC ..... A47C 3/18; A47C 7/004; A47C 7/72
See application file for complete search history.

(56) References Cited

U.S. PATENT DOCUMENTS 2,614,536 A 10/1952 Livers
5,090,770 A * 2/1992 Heinrichs ..... A47C 3/30 188/300
5,755,650 A * 5/1998 Urso ..... A47C 9/002 248/118
7,163,263 B1 * 1/2007 Kurrasch ..... A47C 1/0242 297/217.3
8,016,351 B2 9/2011 Cassaday
8,598,721 B2 12/2013 Baarman et al.
2005/0242635 A1 * 11/2005 Cassaday ..... A47C 1/022 297/217.3
2008/0211684 A1 * 9/2008 Beck ..... A47C 1/0242 340/667
2011/0260469 A1 * 10/2011 Baarman ..... A47C 15/004 290/1 C (Continued)

FOREIGN PATENT DOCUMENTS

CN 1688231 A 10/2005
CN 103859852 A 6/2014
DE 4242601 A1 6/1994

(Continued)

OTHER PUBLICATIONS

European Search Report, dated Apr. 12, 2018.

*Primary Examiner* — Viet P Nguyen
(74) *Attorney, Agent, or Firm* — Lucas & Mercanti, LLP

(57) ABSTRACT

A chair column arrangement of a swivel chair includes an upright tube which has a star base at its end region and in which a support tube is rotatably mounted. An end region of support tube remote from the star base protrudes from the upright tube and carries a seat at its protruding end region. A driven wheel is arranged non-rotationally coaxially on the support tube. A driving wheel arranged on a generator shaft of an electrical generator generating alternating current can be driven rotatably directly or indirectly by the driven wheel, wherein the electrical generator is arranged rigidly on the upright tube.

15 Claims, 1 Drawing Sheet

(56) References Cited

U.S. PATENT DOCUMENTS

2019/0029440 A1* 1/2019 Schmitz ..... A47C 31/126

FOREIGN PATENT DOCUMENTS

| | | | |
|---|---|---|---|
| DE | 202006018040 | U1 | 3/2007 |
| DE | 102016102891 | A1 | 8/2017 |
| TW | 201221091 | A | 6/2012 |
| TW | M503237 | U | 6/2015 |

* cited by examiner

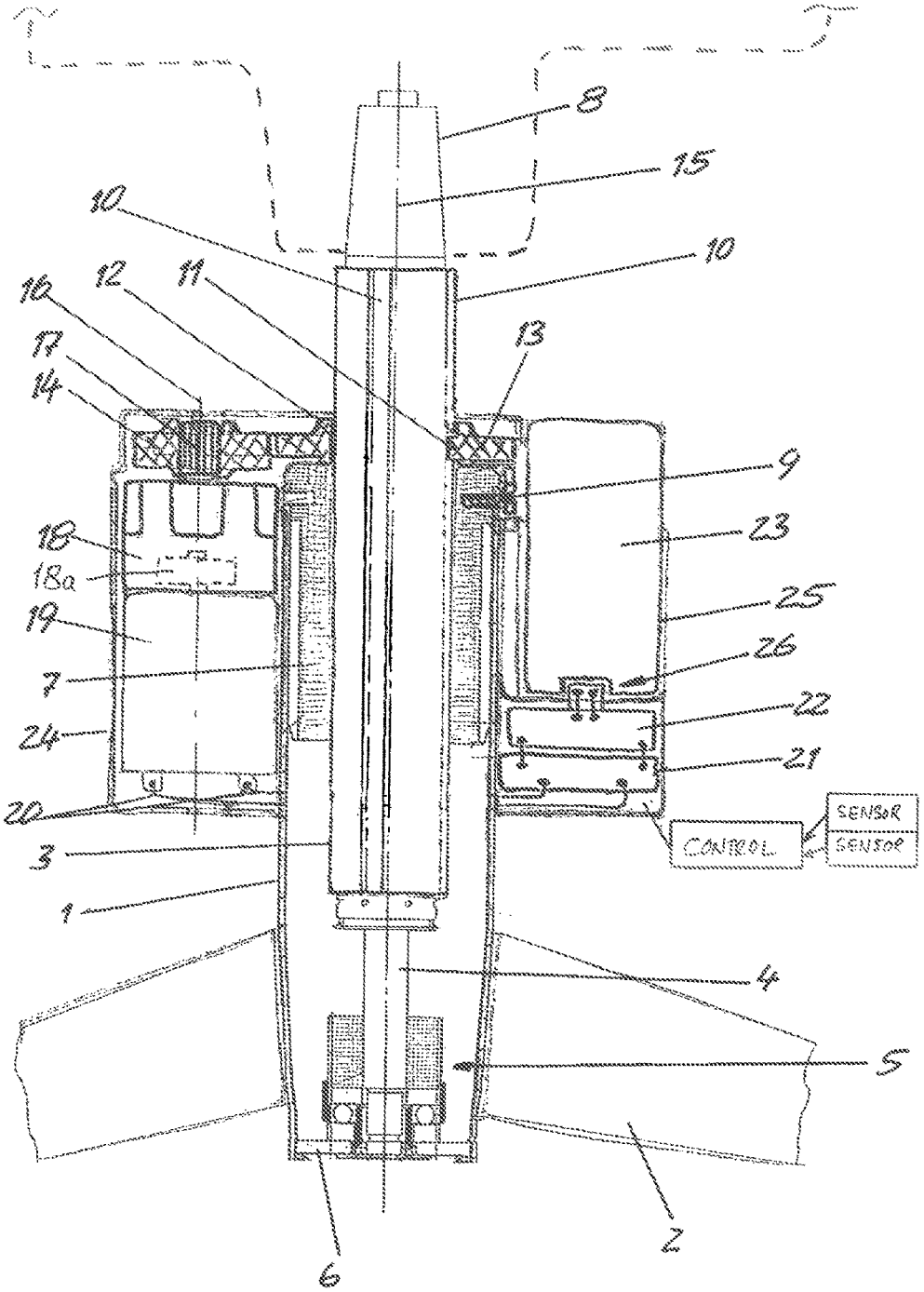
8
15
10
10
12
11
16
17
14
13
9
23
18
18a
25
19
26
7
22
24
21
20
SENSOR
CONTROL
SENSOR
3
1
4
5
6
2

CHAIR COLUMN ARRANGEMENT

CROSS-REFERENCE TO RELATED APPLICATIONS

This application claims priority to German patent application DE 10 2016 124 160.1, filed on Dec. 13, 2016, the entire contents of which are incorporated herein by reference.

BACKGROUND OF THE INVENTION

The invention relates to a chair column arrangement of a swivel chair with an upright tube which has a star base at its end region and in which a support tube is rotatably mounted, the end region of which, remote from the star base, protrudes from the upright tube and carries a seat at its protruding end region.

BRIEF SUMMARY OF THE INVENTION

An object of the invention is to provide a chair column arrangement of the type mentioned at the beginning in which electrical energy can be generated easily.

The object is achieved according to an embodiment of the invention by a chair column arrangement having an upright tube with a star base at a bottom end region and a support tube rotatably mounted in the upright tube and having an end region remote from the star base that protrudes from the upright tube and carries a seat at its protruding end region, a driven wheel arranged non-rotationally coaxially on the support tube, and a driving wheel arranged on a generator shaft of an electrical generator generating alternating current, wherein the driving wheel can be driven rotatably directly or indirectly by the driven wheel, and the electrical generator is arranged rigidly on the upright tube.

This embodiment uses the swiveling movements, which occur continuously when the swivel chair is being used, to drive an electrical generator and consequently generate electrical energy.

The alternating current generated by the electrical generator can be fed to a battery via a rectifier to store the energy obtained.

The battery is preferably a lithium-ion battery, which is characterized by high specific energy. It is thermally stable and is subject to only a very small memory effect.

In an alternative embodiment, the battery is a supercapacitor which has a high power density and can therefore be charged and discharged very quickly and is suitable for a high number of switching cycles.

According to one embodiment, the rectifier is a bridge rectifier, and a current with the same polarity is output, irrespective of which direction of rotation the electrical generator is driven in. All the swiveling movements of the seat are therefore used to generate current, whatever the direction of rotation.

According to an embodiment of the invention, the alternating current generated by the electrical generator is fed to the battery via the rectifier and a step-down converter so that electricity with constant voltage is output to the battery.

According to a further embodiment, the driving wheel is driven rotatably by the driven wheel via a gear, wherein the gear is preferably a planetary gear.

In this way, the rotational speed of the driven wheel is multiplied, which results in an increased amount of alternating current generated by the generator.

The rectifier and the battery can be arranged rigidly on the upright tube. In another embodiment, the step-down converter is also arranged rigidly on the upright tube. The battery can here be both a fixedly installed battery and a replaceable battery.

According to an embodiment of the invention, the driving wheel, together with the gear, the generator, the rectifier, the step-down converter, and the battery, form a compact energy-generating device which can be arranged in a housing below the seat on the upright tube.

To adjust the height of the seat, the support tube is arranged so that it can move coaxially inside the upright tube. The driven wheel fixed axially on the guide tube has a central recess by means of which it is guided so that the driven wheel can move on the external surface of the support tube.

On its outer radially circumferential surface, the support tube here has one or more longitudinal grooves into which the guide blocks of the driven wheel project radially inward.

If the swivel chair has equipment to which electricity can be applied, the direct current stored in the battery can be supplied to the equipment of the swivel chair to which electricity can be applied. There is thus no need to externally charge the battery for operating the equipment to which electricity can be applied.

The equipment to which electricity can be applied can here be adjustment equipment for adjusting a motor-adjustable component of the swivel chair.

According to an embodiment of the invention, the direct current of the battery is applied to the generator to operate a motor.

It is thus possible, for example, for the seat to be swiveled back into its original position or a predetermined swiveled position when the weight is taken off the seat again after weight has been placed on it and it has been swiveled.

When weight is placed on the seat and/or the original position, a predetermined swiveled position can thus be detected by sensors which feed the detected values to a control unit which then controls the generator when the motor is operating.

If it is intended that a corresponding adjustment does not take place immediately after weight is taken off the seat but only after a delay of a determined amount of time, the control system can have a corresponding delay element.

BRIEF DESCRIPTION OF THE DRAWING

An exemplary embodiment of the invention is shown in the drawings and is described in detail below. The single FIGURE in the drawings shows a longitudinal cross section of a chair column arrangement.

DETAILED DESCRIPTION OF THE PREFERRED EMBODIMENTS

The chair column arrangement shown has an upright tube 1, on the lower end of which a star base 2 is arranged.

A support tube 3 which forms a cylinder of a gas spring is arranged inside the upright tube 1. At the lower end of the support tube 3, a piston rod 4 passes out of the support tube 3, the free end of which piston rod is mounted rotatably in a bearing arrangement 5 about a support tube axis 15, wherein the bearing arrangement 5 is arranged rigidly on a base plate 6 which closes the lower end of the upright tube 1.

A guide bush 7 is inserted into the upper end region of the upright tube 1 and rigidly connected to the upright tube 1 by press-fitting, wherein the support tube 3 is guided rotatably and axially movably in the guide bush 7.

At the end protruding from the upright tube 1, the support tube 3 has a cone 8 providing a connecting element to which a seat can be fastened (a lower portion of the seat is shown in dashed lines in the FIGURE).

The support tube 3 is a profile tube with longitudinal grooves 10 distributed over the circumference and extending in the longitudinal direction of the support tube 3. Guide blocks 11 of a driven wheel 13, which is pushed onto the support tube 3 with its coaxial recess 12 and is fixed with respect to rotation on the support tube 3 so that when the support tube 3 swivels the driven wheel 13 rotates with it, project into the longitudinal grooves 10.

The driven wheel 13 engages in a planetary gear 14 which is arranged rigidly on a planetary gear shaft 17 and is mounted so that it can rotate about a planetary gear axis 16 parallel to the support tube axis 15.

The planetary gear shaft 17 projects into a gear housing 18 inside which a planetary gear (not shown) is arranged which can be driven rotatably by the planetary gear shaft 17 and thus increases its speed of rotation.

A driving wheel 18*a* of an electrical generator 19 is driven by the planetary gear in the gear housing at this increased speed of rotation, as a result of which the generator 19 generates an electrical alternating current which is fed to a bridge rectifier 21 via cables 20. A current with the same polarity is output at the output of the bridge rectifier 21 which is independent of the direction of rotation in which the electrical generator 19 is driven.

This electrical alternating current is supplied to a lithium-ion battery 23 as electricity with a constant voltage via a step-down converter 22.

The driven wheel 13, the planetary gear 14, the gear housing 18 of the planetary gear, the electrical generator 19, the bridge rectifier 21, and the step-down converter 22 are enclosed by a housing 24 connected to the upright tube 1 which has a pocket 25 for holding the lithium-ion battery 23. The housing 24 is rigidly connected to the upright tube 1 by screws 9. The replaceable lithium-ion battery 23 inserted into the pocket can be connected in an electrically conductive fashion to the step-down converter 22 via plug contacts 26.

Electrical energy stored in the battery 23 can be supplied to equipment of the swivel chair such as, for example, the generator 19. A controller 27 receives an input from sensors that detect a swivel position and when weight is placed on the seat. Accordingly, the controller 27 can control the generator to swivel the seat back to its original position or to a predetermined swiveled position.

LIST OF REFERENCE NUMERALS

1 upright tube
2 star base
3 support tube
4 piston rod
5 bearing arrangement
6 base plate
7 guide bush
8 cone
9 screws
10 longitudinal grooves
11 guide blocks
12 coaxial recess
13 driven wheel
14 planetary gear
15 support tube axis
16 planetary gear axis
17 planetary gear shaft
18 gear housing
18*a* driving wheel
19 generator
20 cables
21 bridge rectifier
22 step-down converter
23 lithium-ion battery
24 housing
25 pocket
26 plug contacts

The invention claimed is:

1. A chair column arrangement of a swivel chair, comprising:

an upright tube with a star base at an end region;

a support tube rotatably mounted in the upright tube so that the support tube rotates about a longitudinal axis, the support tube having an end region remote from the star base that protrudes from the upright tube with a connecting element for carrying a seat;

a driven wheel arranged non-rotationally coaxially on the support tube, wherein the support tube is arranged so that it swivels by rotating coaxially inside the upright tube, the driven wheel fixed axially with respect to the longitudinal axis relative to the upright tube, and the driven wheel has a coaxial recess configured so that the driven wheel is rotatable with the external surface of the support tube when the support tube swivels;

a generator arranged rigidly on the upright tube and having a generator shaft;

a driving wheel arranged on the generator shaft of the electrical generator, the driving wheel being driven rotatably directly or indirectly by the driven wheel.

2. The chair column arrangement according to claim 1, further comprising a battery and a rectifier, wherein an alternating current generated by the electrical generator is fed to the battery by the rectifier.

3. The chair column arrangement according to claim 2, wherein the battery is a lithium-ion battery.

4. The chair column arrangement according to claim 2, wherein the battery is a super-capacitor.

5. The chair column arrangement according to claim 2, wherein the rectifier is a bridge rectifier.

6. The chair column arrangement according to claim 2, further comprising a stepdown converter, wherein the alternating current generated by the electrical generator is fed to the battery by the rectifier and the step-down converter.

7. The chair column arrangement according to claim 6, wherein the rectifier, the battery, and the step-down converter are arranged rigidly on the upright tube.

8. The chair column arrangement according to claim 2, wherein the rectifier and the battery are arranged rigidly on the upright tube.

9. The chair column arrangement according to claim 8, wherein the support tube has a longitudinal groove on its outer radially circumferential surface, and the driven wheel has a guide block that projects radially inward into the at least one longitudinal groove.

10. The chair column arrangement according to claim 2, wherein electrical energy stored in the battery is supplied to equipment of the swivel chair to which electricity is applied.

11. The chair column arrangement according to claim 10, wherein the equipment to which the electrical energy is applied is an adjustment equipment.

12. The chair column arrangement according to claim 11, wherein the electrical energy from the battery is applied to the generator to operate a motor.

13. The chair column arrangement according to claim 10, further comprising a controller to control the supply of the electrical energy to the equipment.

14. The chair column arrangement according to claim 1, wherein the driving wheel is driven rotatably by the driven wheel by a gear.

15. The chair column arrangement according to claim 14, wherein the gear is a planetary gear.

* * * * *